US005299475A

United States Patent [19]

Stroop

[11] Patent Number: 5,299,475

[45] Date of Patent: Apr. 5, 1994

[54] TOOL AND ADJUSTABLE HANDGRIP

[76] Inventor: Jeffrey A. Stroop, 1914 Saddlebrook Dr., Murfreesboro, Tenn. 37129

[21] Appl. No.: 9,148

[22] Filed: Jan. 26, 1993

[51] Int. Cl.[5] ..... B25G 1/01

[52] U.S. Cl. ..... 81/489; 81/20; 16/110 R

[58] Field of Search ..... 81/20, 177.1, 489; 16/110 R; 7/143

[56] References Cited

U.S. PATENT DOCUMENTS

| | | | |
|---|---|---|---|
| 3,189,069 | 6/1965 | Stowell | 16/110 R X |
| 3,208,724 | 9/1965 | Vaughan | 81/20 X |
| 4,154,273 | 5/1979 | Pollak | 81/20 |
| 4,404,708 | 9/1983 | Winter | 81/20 |
| 4,721,021 | 1/1988 | Kusznir | 81/489 X |
| 5,056,381 | 10/1991 | Carmen | 81/20 X |

*Primary Examiner*—James G. Smith
*Attorney, Agent, or Firm*—Leon Gilden

[57] ABSTRACT

A tool having a tool shank, includes a tool shank handle fixedly mounted to the tool shank, with respective first and second handle sleeves mounted in coextensive relationship relative to one another about the handle to provide for affording handgrips of adjustable widths to accommodate various individuals.

4 Claims, 4 Drawing Sheets

TOOL AND ADJUSTABLE HANDGRIP

BACKGROUND OF THE INVENTION

1. Field of the Invention

The field of invention relates to tool apparatus, and more particularly pertains to a new and improved tool and adjustable handgrip wherein a plurality of sleeves are mounted in a removable relationship relative to a handle of the tool structure to provide for handgrips of various thicknesses.

2. Description of the Prior Art

The prior art has heretofore afforded handle grips of various thicknesses to accommodate the handgrip capacity of individuals of varying physiology. Typically and by way of example, optimum size for gripping has been indicated to extend between 1.25 inches and 1.75 inches in diameter. Due to such varying thicknesses, the instant invention attempts to overcome deficiencies of the prior art by providing for handgrips to accommodate the comfort level of various individuals in grasping of such handles, wherein various physical maladies such as carpal tunnel syndrome and the like have been resultant at least in part to improperly sized tools. The instant invention attempts to overcome such deficiencies by providing for a tool structure arranged to provide for handgrips of various thicknesses and in this respect, the present invention substantially fulfills this need.

SUMMARY OF THE INVENTION

In view of the foregoing disadvantages inherent in the known types of tool structure now present in the prior art, the present invention provides a tool and adjustable handgrip wherein the same is arranged to provide for sleeve members to provide for handgrips of various sizes relative to an associated tool. As such, the general purpose of the present invention, which will be described subsequently in greater detail, is to provide a new and improved tool and adjustable handgrip which has all the advantages of the prior art tool structure and none of the disadvantages.

To attain this, the present invention provides a tool having a tool shank, including a tool shank handle fixedly mounted to the tool shank, with respective first and second handle sleeves mounted in coextensive relationship relative to one another about the handle to provide for affording handgrips of adjustable widths to accommodate various individuals.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tool and adjustable handgrip which has all the advantages of the prior art tool structure and none of the disadvantages.

It is another object of the present invention to provide a new and improved tool and adjustable handgrip which may be easily and efficiently manufactured and marketed.

It is a further object of the present invention to provide a new and improved tool and adjustable handgrip which is of a durable and reliable construction.

An even further object of the present invention is to provide a new and improved tool and adjustable handgrip which is susceptible of a low cost of manufacture with regard to both materials and labor, and which accordingly is then susceptible of low prices of sale to the consuming public, thereby making such tool and adjustable handgrip economically available to the buying public.

Still yet another object of the present invention is to provide a new and improved tool and adjustable handgrip which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
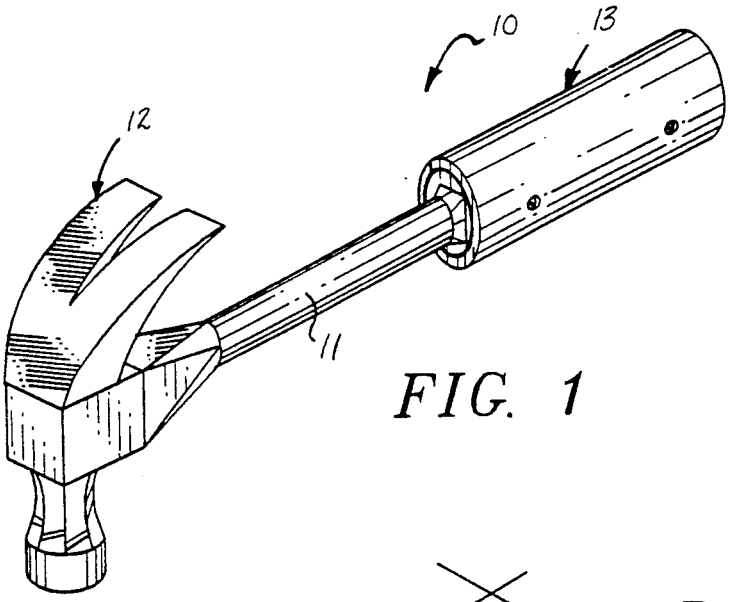
FIG. 1 is an isometric illustration of the invention.

With reference now to the drawings, and in particular to FIGS. 1 to 10 thereof, a new and improved tool and adjustable handgrip embodying the principles and concepts of the present invention and generally designated by the reference numeral 10 will be described.

Figure 2:
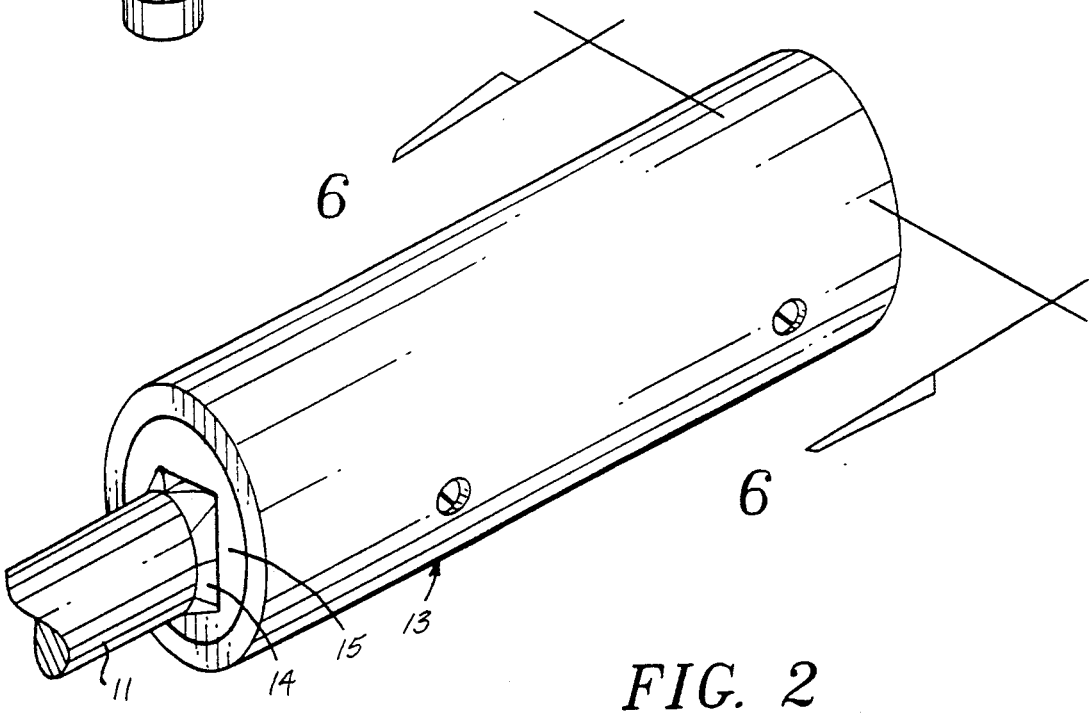
FIG. 2 is an enlarged isometric illustration of the handle portion of the tool structure.
Figure 3:
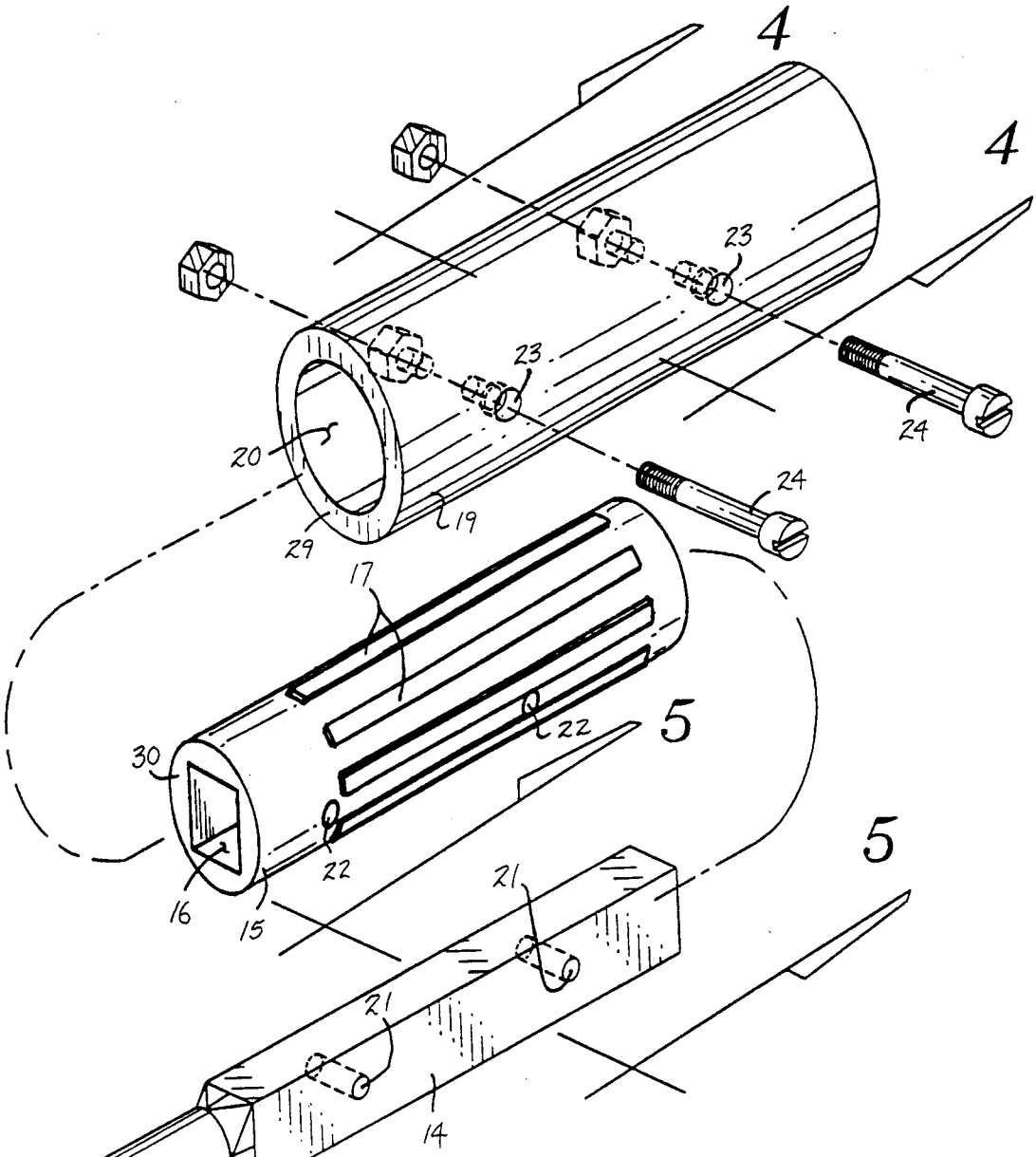
FIG. 3 is an isometric exploded view illustrating the sleeve structure relative to the tool handle.
Figure 5:
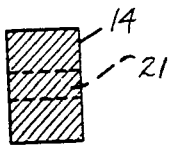
FIG. 5 is an orthographic view, taken along the lines 5—5 of FIG. 3 in the direction indicated by the arrows.
Figure 4:
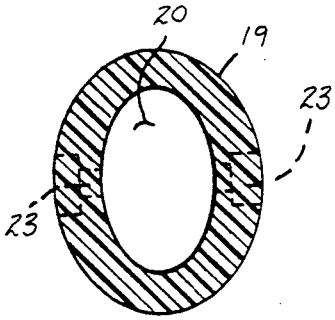
FIG. 4 is an orthographic view, taken along the lines 4—4 of FIG. 3 in the direction indicated by the arrows.

More specifically, the tool and adjustable handgrip 10 of the invention essentially comprise a tool shank 11, having a tool head 12 mounted at a first end of the shank. The tool shank may be of a hammer configuration as indicated, but may accordingly be of other configurations of tool structure to include wrenches and the like, with the hammer head structure indicated by means of example but not to be exclusive thereto. The tool shank includes a tool handle 13 that is arranged and mounted to the tool shank extending from the tool shank second end in a spaced relationship relative to the tool head 12. The tool handle 13 includes an elongate handle member 14 integral with and extending from the tool shank second end a predetermined length of a predetermined parallelepiped configuration. A first resilient sleeve 15 having a first sleeve cavity 16, with the cavity 16 of said predetermined parallelepiped configuration and of said predetermined length, arranged for slidable reception of the elongate handle member 14 therewithin. The first handle sleeve 15, the handle member 14, and a second handle sleeve 19 are each of said predetermined length, with the second handle sleeve 19 having a second sleeve cavity 20 to complementarily receive the first handle sleeve 15 therewithin. It should be further noted that the first handle sleeve includes a plurality of parallel resilient compressible ribs 17 arranged in an annular array exteriorly of the first handle sleeve to enhance grasping, wherein the ribs are compressible and received within the second handle sleeve cavity 20. First bores 21 are directed through the handle member 14, with second bores 22 directed through the first sleeve 15, and third bores 23 directed through the second sleeve 19. The first, second, and third bores 21, 22, and 23 are arranged in a coaxially aligned relationship when in an assembled configuration, as indicated in FIG. 2 for example, and if desired, a plurality of pairs of first, second, and third respective bores 21, 22, and 23 are provided, with each aligned set of first, second, and third bores arranged to receive a fastener 24 therethrough to secure the handle member 14, the first sleeve 15, and the second sleeve 19 in an assembled configuration. Typically, the third sleeve 19 is of a substantially rigid configuration but may be of a resilient configuration if desired.

Figure 6:
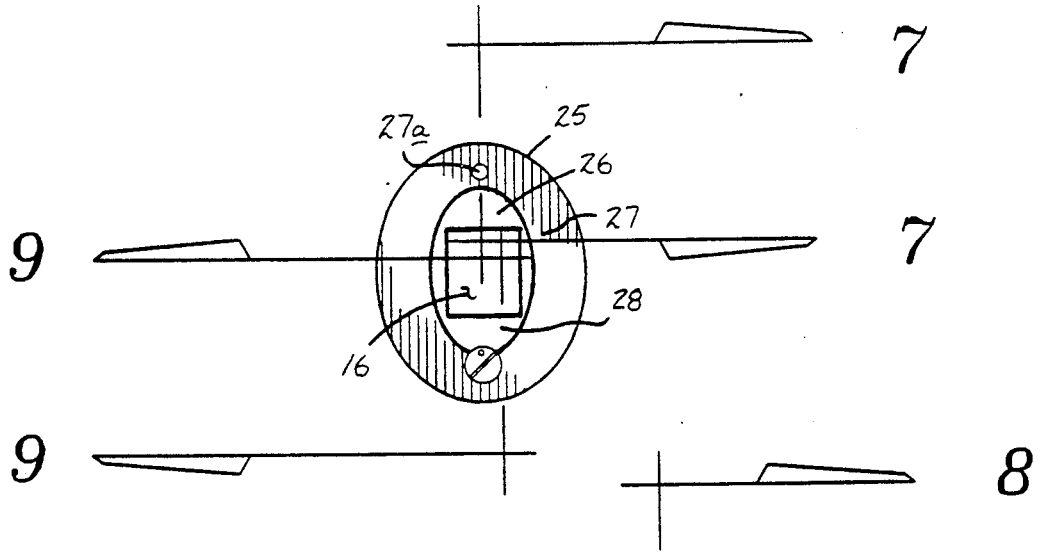
FIG. 6 is an orthographic view, taken along the lines 6—6 of FIG. 2 in the direction indicated by the arrows.
Figure 7:
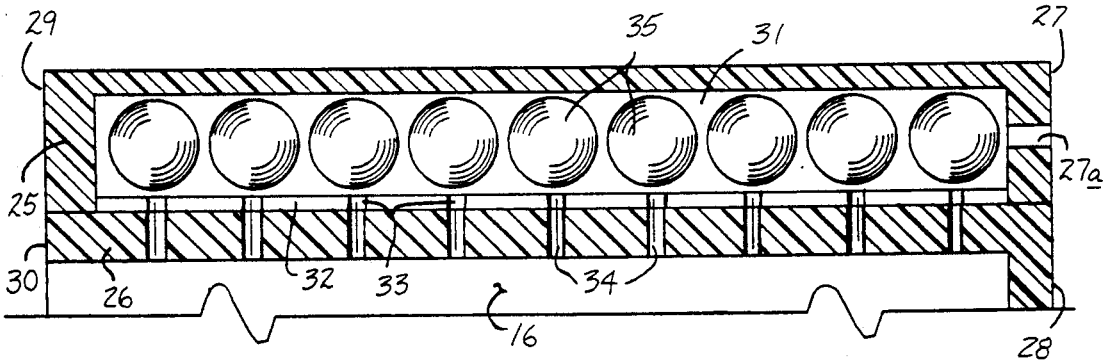
FIG. 7 is an orthographic view, taken along the lines 7—7 of FIG. 6 in the direction indicated by the arrows.
Figure 8:
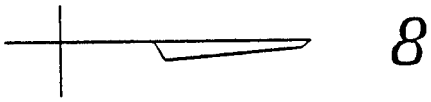
FIG. 8 is an orthographic view, taken along the lines 8—8 of FIG. 7 in the direction indicated by the arrows.
Figure 8:
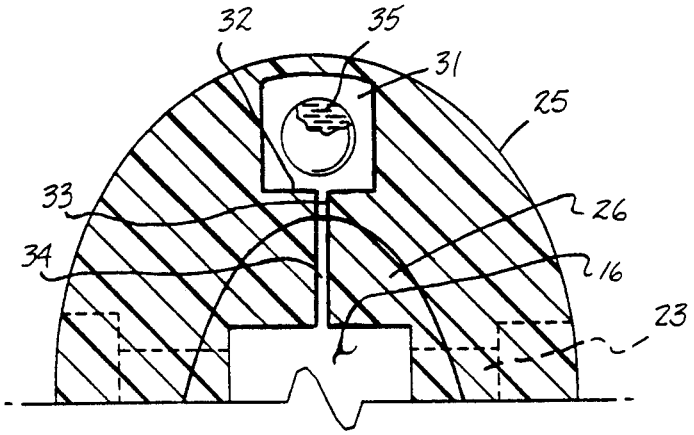
Figure 9:
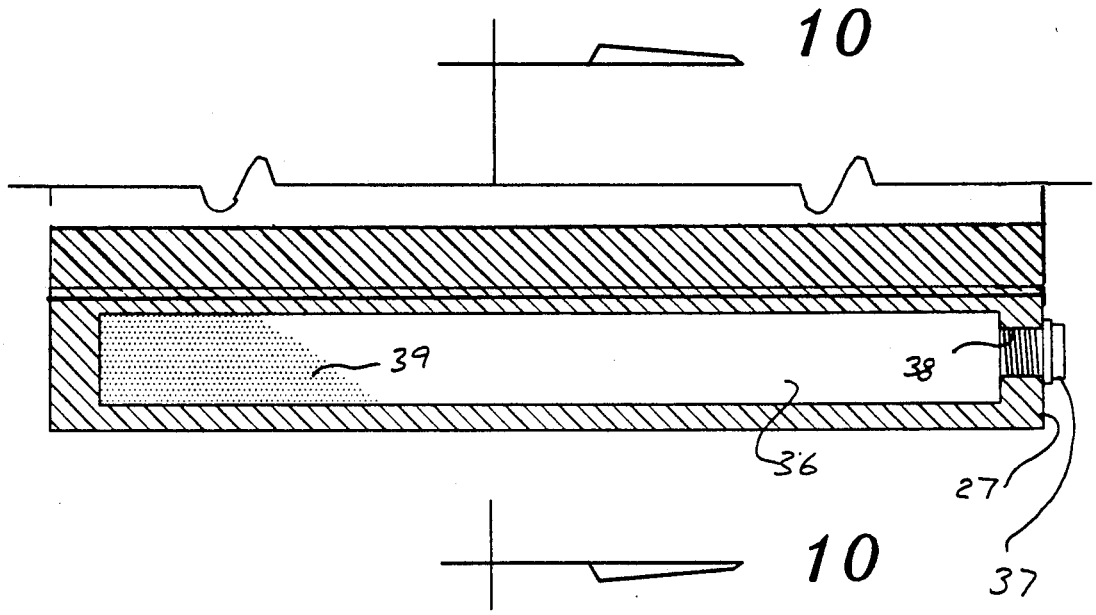
FIG. 9 is an orthographic view, taken along the lines 9—9 of FIG. 6 in the direction indicated by the arrows.
Figure 10:
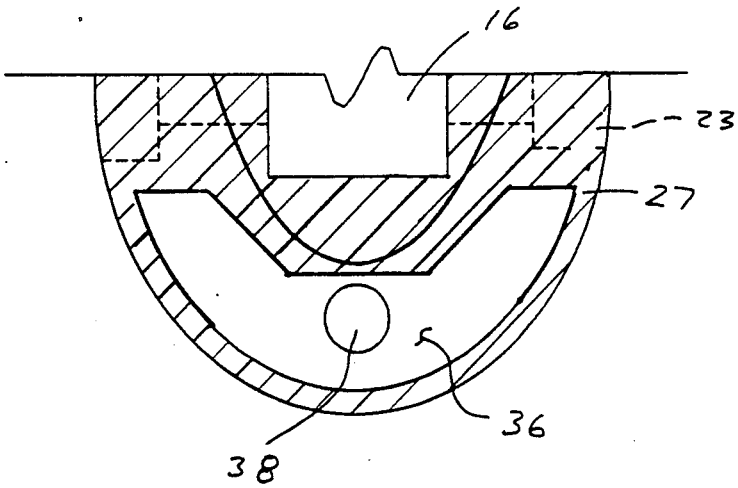
FIG. 10 is an orthographic view, taken along the lines 10—10 of FIG. 9 in the direction indicated by the arrows.

The FIG. 6 indicates the construction of a modified second sleeve structure 25 in lieu of the second sleeve 19 cooperative with a modified first sleeve 26 in lieu of the first sleeve 15, with the second sleeve 25 having a second sleeve end wall 27 coplanar with the first sleeve second end wall 28 and a second sleeve first end wall 29 coplanar with the first sleeve first end wall 30. A second sleeve second end wall aperture 27*a* is directed into the second sleeve second end wall 27 in communication with a second sleeve first chamber 31, having positioned therewithin a plurality of frangible glue capsules 35, each containing a fluid adhesive therewithin, in a manner as indicated in the FIGS. 7 and 8. The second sleeve first chamber 31 includes a first chamber floor 32 in adjacency to the first sleeve 26, with the first chamber floor 32 having a plurality of floor apertures 33 in communication with and directed through first sleeve apertures 34 through the first sleeve 28 and in communication with the first sleeve cavity 16, whereupon a pointed instrument may be directed through the second sleeve second end wall aperture 27*a* to rupture one or a plurality of the capsules 35 to insure permanent bonding of the sleeves together in lieu of the fasteners 24. A second sleeve second chamber 36 directed into the second sleeve spaced from the first chamber 31 includes a plug bore 38 having a removable bore plug 37 therewithin, with the second sleeve second chamber 36 having rosin powder and the like 39 therewithin permitting its dispensing upon an individual's hands to provide for assistance in handgrip of the tool structure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tool and adjustable handgrip arrangement comprising, a tool shank, the tool shank having a shank first end, with a tool head mounted to the first end, and the shank having a shank second end, with a handle assembly extending along the tool shank symmetrically oriented about the tool shank from the second end in a spaced relationship relative to the tool head, and the handle assembly includes an elongate handle member of rigid construction fixedly mounted to the handle shank, and at least a first handle sleeve, with the handle member having a predetermined length and the first handle sleeve having a length equal to said predetermined length, and the handle member is of a parallelepiped configuration, and the first handle sleeve includes a first handle sleeve cavity of said parallelepiped configuration to complementarily receive the handle member therewithin, and the first handle sleeve formed of a resilient material, and the handle sleeve includes a plurality of parallel resilient ribs of compressible construction in an annular array about the first handle sleeve, and a second handle sleeve, the second handle sleeve having a second sleeve length equal to said predetermined length, and including a second sleeve cavity to complementarily receive the first handle sleeve therewithin, and at least a first bore directed through the handle member, a second bore directed through the first handle sleeve, and a third bore directed through the second handle sleeve, with the first bore, the second bore, and the third bore coaxially aligned, and a fastener directed through the first bore, the second bore, and the third bore to secure the handle member, the first handle sleeve and the second handle sleeve together.

2. A handgrip as set forth in claim 1 wherein the second sleeve includes a second sleeve first end wall spaced from a second sleeve second end wall, and the second sleeve second end wall positioned in a coplanar relationship with the tool shank second end, and the second handle sleeve having a first chamber positioned between the second sleeve first end wall and the second sleeve second end wall, and a second end wall aperture directed through the second sleeve second end wall, and a plurality of frangible glue capsules contained within the first chamber, the first chamber having a first chamber floor and a plurality of first chamber apertures directed through the floor in communication with the first chamber, with each of the capsules including a fluid adhesive therewithin permitting rupture selectively of the glue capsules upon directing a tool member through the first end wall apertures.

3. A handgrip as set forth in claim 2 wherein the first sleeve includes a plurality of first sleeve apertures, wherein each of said first sleeve aperture is aligned with one of said floor apertures of said first chamber to direct said fluid adhesive through the floor apertures and the first sleeve apertures into communication with the handle member to adhesive securement of the handle member, the first sleeve, and the second sleeve together.

4. A handgrip as set forth in claim 3 wherein the second sleeve includes a second sleeve second chamber spaced from the first chamber, the second chamber having a second chamber bore directed through the second sleeve second end wall, and a bore plug removably mounted through the second chamber bore, and rosin powder contained within the second sleeve second chamber for selective dispensing therefrom.

* * * * *